US007931152B2

(12) United States Patent
Lahteenmaki et al.

(10) Patent No.: US 7,931,152 B2
(45) Date of Patent: Apr. 26, 2011

(54) SHUFFLING APPARATUS AND METHOD FOR ALIGNING WOOD LOGS IN A CONVEYOR

(75) Inventors: Janne Lahteenmaki, Alpharetta, GA (US); Lennart Thornquist, Doraville, GA (US); Pekka Kokko, Hollola, FL (US); Jaakko Pitkakangas, Hollola, FL (US)

(73) Assignee: Andritz Oy, Helsinki (FI)

( * ) Notice: Subject to any disclaimer, the term of this patent is extended or adjusted under 35 U.S.C. 154(b) by 813 days.

(21) Appl. No.: 11/770,133

(22) Filed: Jun. 28, 2007

(65) Prior Publication Data

US 2008/0017480 A1 Jan. 24, 2008

Related U.S. Application Data

(60) Provisional application No. 60/818,982, filed on Jul. 7, 2006.

(51) Int. Cl.
*B07C 5/14* (2006.01)

(52) U.S. Cl. ..... 209/519; 209/521; 198/597

(58) Field of Classification Search ..... 209/517–519, 209/521; 198/375, 463.6, 468.6, 550.2, 576, 198/578, 597, 598; 193/2 B; 144/4.1, 4.2, 144/248.5, 248.6, 335, 340

See application file for complete search history.

(56) References Cited

U.S. PATENT DOCUMENTS

| | | | | | |
|---|---|---|---|---|---|
| 3,054,514 | A * | 9/1962 | Riley | 414/746.2 |
| 3,215,176 | A * | 11/1965 | Ferrabee | 144/208.9 |
| 4,193,486 | A * | 3/1980 | Borzym et al. | 193/35 R |
| 4,341,248 | A * | 7/1982 | Critchell et al. | 144/378 |
| 4,369,823 | A * | 1/1983 | Gustafsson | 144/340 |
| 4,590,979 | A * | 5/1986 | Attems | 144/208.4 |
| 4,694,636 | A * | 9/1987 | Griffin | 53/399 |
| 4,911,283 | A * | 3/1990 | Hollins | 198/463.5 |
| 5,337,811 | A * | 8/1994 | Fulghum et al. | 144/208.9 |
| 5,374,157 | A * | 12/1994 | Allard | 414/746.6 |
| 5,669,428 | A * | 9/1997 | Hoover | 144/245.2 |
| 6,698,578 | B2 * | 3/2004 | Lepage | 198/550.1 |
| 6,705,456 | B2 | 3/2004 | Blaylock et al. | |
| 6,761,261 | B2 * | 7/2004 | Dussault et al. | 198/773 |
| 7,152,728 | B2 * | 12/2006 | Woodham | 198/463.1 |
| 7,673,734 | B2 * | 3/2010 | Manders | 198/456 |
| 7,681,711 | B2 * | 3/2010 | Borsarelli et al. | 198/429 |

* cited by examiner

*Primary Examiner* — Douglas A Hess
(74) *Attorney, Agent, or Firm* — Nixon & Vanderhye P.C.

(57) ABSTRACT

A log shuffler and conveyor assembly including: a chute including a log conveyor having a bottom surface and at least one sidewall; a gap in the log conveyor, and a log shuffler arranged in the gap of the conveyor, wherein the shuffler includes at least one pivoting plate having a first edge moving reciprocally above and below the bottom surface of the chute.

20 Claims, 4 Drawing Sheets

SHUFFLING APPARATUS AND METHOD FOR ALIGNING WOOD LOGS IN A CONVEYOR

RELATED APPLICATION

This application claims the benefit of the filing date of U.S. Provisional Patent Application Ser. No. 60/818,982, filed Jul. 7, 2006, the entirety of which is incorporated by reference herein.

BACKGROUND OF THE INVENTION

The present invention relates to conveyors for logs, and particularly to agitating devices for aligning logs within conveyors.

Logs are typically moved between wood processing stations by conveyors. Logs tend not to stack evenly or uniformly in conveyors. Rather, the stacked logs tend to be misaligned, crooked and unsettled in the conveyor. Maintaining alignment of logs in a conveyor is difficult because logs are irregular in shape and enter the conveyor askew. Logs have different lengths, diameters, shapes and surface features. Keeping logs aligned as they are being conveyed is desirable so that the logs are uniformly arranged as they enter a processing station downstream of the conveyor.

There is a long felt need for a conveyor that aligns logs before discharging them from the conveyor. The need is particularly acute for conveyors that feed logs to cutting devices, such as stranders (also referred to as a flaker) that cut logs into wafers used to form strandboard. Irregularities in the alignment of logs entering a cutting device may reduce the precision of the cutting operation. The reduced cutting precision may cause inefficiencies, such as wasted wood materials, during the cutting operation. The efficiency of the cutting operations may be increased by feeding logs aligned parallel to the conveyor path and uniformly stacked to the cutting device.

SUMMARY OF THE INVENTION

A conveyor has been developed that shuffles logs within the conveyor to align the logs with the movement direction of the conveyor and to settle the longs in a compact log stack. The conveyor has a chute, a conveyor and a log shuffler that agitates the logs in the chute. The shuffler may be a pair of reciprocating lifting plates in the chute that agitates the logs to settle the logs into a stack.

The log shuffler may include a pair of L-shaped plates transverse to the chute. Inside edges of the plate pair abut the bottom and sides of the log stack. The plates reciprocate, e.g., pivot back and forth, so that the inside edges of the plates lift and shift the logs along the bottom and sides of the chute and thereby agitate the logs in the conveyor chute. The agitation shuffles the logs such that they settle into alignment with the chute and each other.

A method has been developed for aligning logs in a chute comprising: moving the logs into the chute such that logs are on top of each other; agitating the logs to impart at least pitch and yaw movement to the logs; and settling the logs in the chute such that the logs are parallel to a lateral axis of the chute. The method may include cyclically lifting opposite ends of the log stack and abutting opposite sides of the log stack.

A log shuffler and conveyor assembly has been developed including: a chute including a log conveyor having a bottom surface and at least one sidewall; a gap in the log conveyor, and a log shuffler arranged in the gap of the conveyor, wherein the shuffler includes at least one pivoting plate having a first edge moving reciprocally above and below the bottom surface of the chute.

A log processing system has been developed comprising: a log conveyor including a generally straight log chute and a log conveying mechanism; a log debarker having an output arranged to discharge logs into the conveyor; a wood cutting device having an input to receive logs from the conveyor, and a log shuffling device positioned in the chute, said log shuffling device operative to agitate a stack of logs in the chute.

The shuffling device may comprise a reciprocating plate engaging at least a bottom and a side of a stack of logs in the chute. Further, the log shuffling device may include a first log shuffler and a second log shuffler separated in the chute by less than the length of a typically log, wherein the first log shuffler moves in a first agitating cyclical motion and the second log shuffler moves in a second agitating cyclical motion that is out of phase with the first agitating cyclical motion.

DETAILED DESCRIPTION OF THE INVENTION

Figure 1:
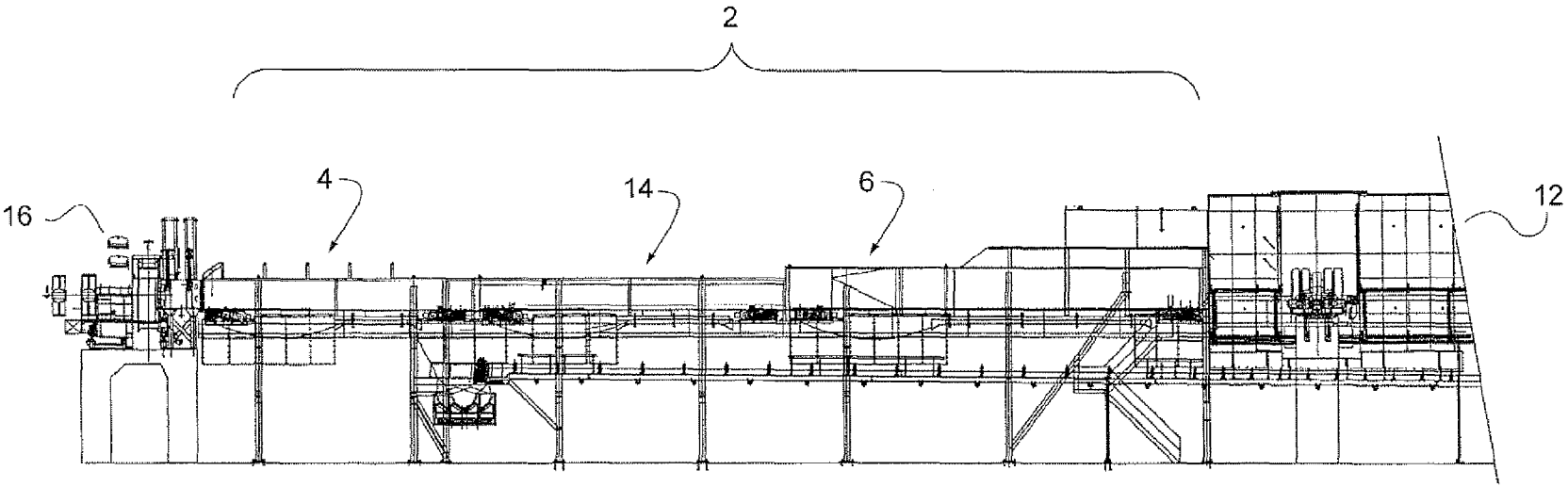
FIG. 1 is a schematic diagram of a debarker, log chute conveyor and a strander.

FIG. 1 is a schematic diagram of logs 10 entering a debarker 12, e.g., an Andritz Rotabarker™, which removes bark from the logs. From the debarker, the logs enter a conveyor 2 that transports the logs to a strander 16. The conveyor 2 may include an infeed conveyor 4, a shuffling conveyor 14 and discharge conveyor 6. The discharge conveyor receives logs from the debarker and outputs logs to the shuffling conveyor. The infeed conveyor receives logs from the shuffling conveyor and outputs logs to the strander.

The bark of the logs 10 is removed in the debarker 12. From the debarker, the logs enter the conveyor 14 as a generally continuous stream of logs. A difficulty with debarkers is that they tend to output logs in a disorderly manner such that the logs are askew as they enter the conveyor. The logs may be dropped into the entrance of the conveyor or enter the conveyor at about the same elevation as the conveyor. The logs entering the conveyor are not uniformly arranged, and are of irregular sizes and shapes. The logs tend to move through the conveyor in bunches with logs on top of other logs.

As shown in FIGS. 2 to 5, the shuffling conveyor 14 may have a relatively straight chute 18 for the logs. The chute includes a conveyor mechanism, such as conventional chain conveyor or roller conveyor, arranged on a floor 20 of the chute. The conveyor mechanism may extend the entire length of the chute or along a portion(s) of the chute. The conveyor mechanism may include electric motors 22 to drive the conveyor along the chute path.

The conveyor operates on a start-stop cycle that may be about a 20-second cycle. During a brief initial portion of the cycle, e.g., 2 to 3 seconds, the conveyor mechanism in the chute moves the logs through the conveyor such that new logs enter the chute and logs already in the conveyor are discharged from the conveyor. During the remaining portion of the cycle, e.g. 17-seconds, the logs are not moved laterally through the chute of the conveyor, but are "shuffled" and may be repeatedly shuffled within the conveyor chute 18.

Logs go through several shuffles as they move through the chute and out to the strander. The movement by the conveyor may be relatively short, such as a movement advancement of 30 inches (76 cm) which is the typical strander cut length for logs. Logs are typically about 30 feet (9 meters) in length in the chute. As each log advances in 30 inch increments through the shuffling conveyor (about 25 feet or 7.6 meters), each logs is subjected to a dozen or more shuffling cycles.

Shuffling is a process in which the logs in the chute are agitated and aligned with respect to the chute and other logs in the chute. For example, the logs are shuffled such that they are generally parallel to the lateral axis of the chute. The shuffling of the logs also causes the logs to settle in the chute and on top of other logs such that a generally orderly stack of logs is formed in the chute.

Shuffling involves the movement of logs within the chute to allow gravity and the agitation of the logs to align the logs into an orderly stack. Gravity and agitation causes the logs to move with respect to each other and the chute such that the logs settle to the bottom floor 20 of the chute and fill in empty spaces between the logs in the chute. By settling within the chute, the logs become parallel to the axis of the chute and with respect to other logs. Further, the height of the stack of logs in the chute is reduced as the logs are shuffled and settle in the chute. Shuffling shifts the logs in the chute such that logs become aligned with the chute and drop to a lower position in the chute.

Figure 2:
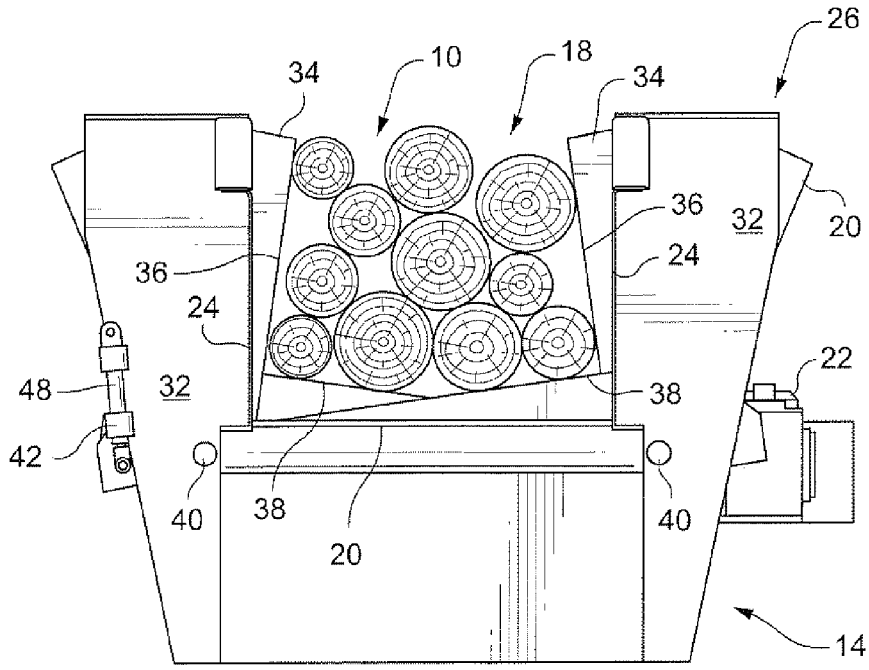
FIG. 2 is an end view of a conveyor shown in FIG. 1 having logs stacked in the conveyor.
Figure 3:
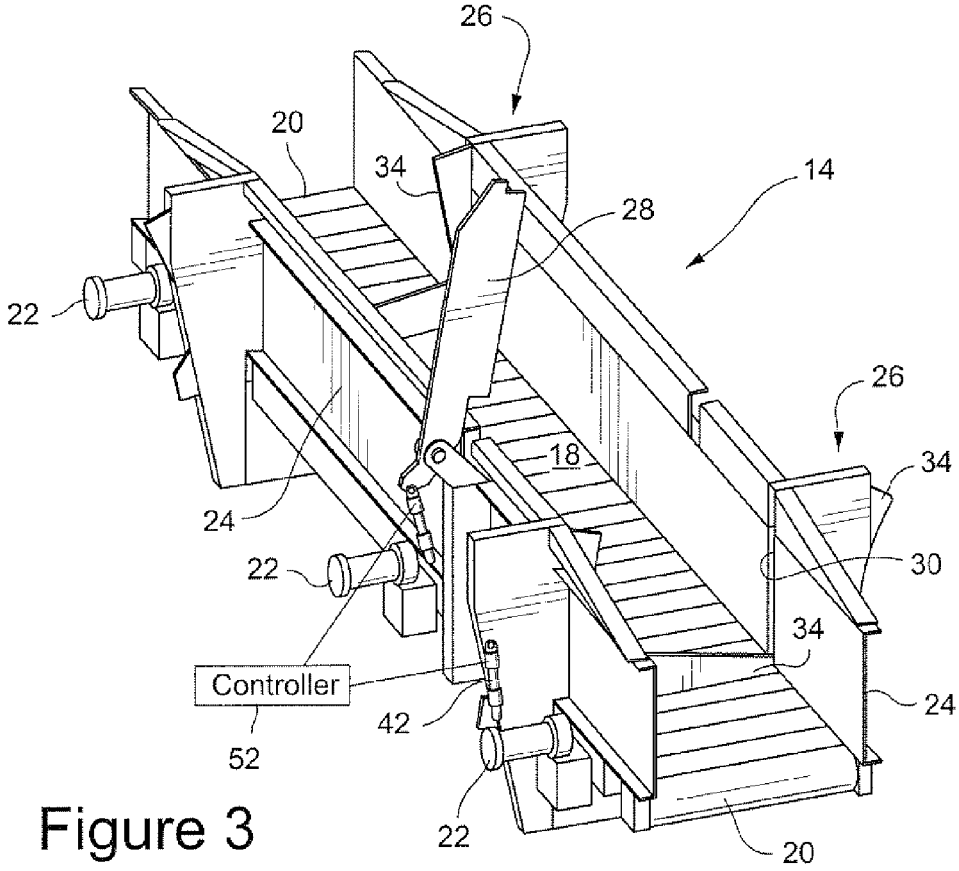
FIG. 3 is perspective view of the conveyor shown in FIG. 1.
Figure 4:
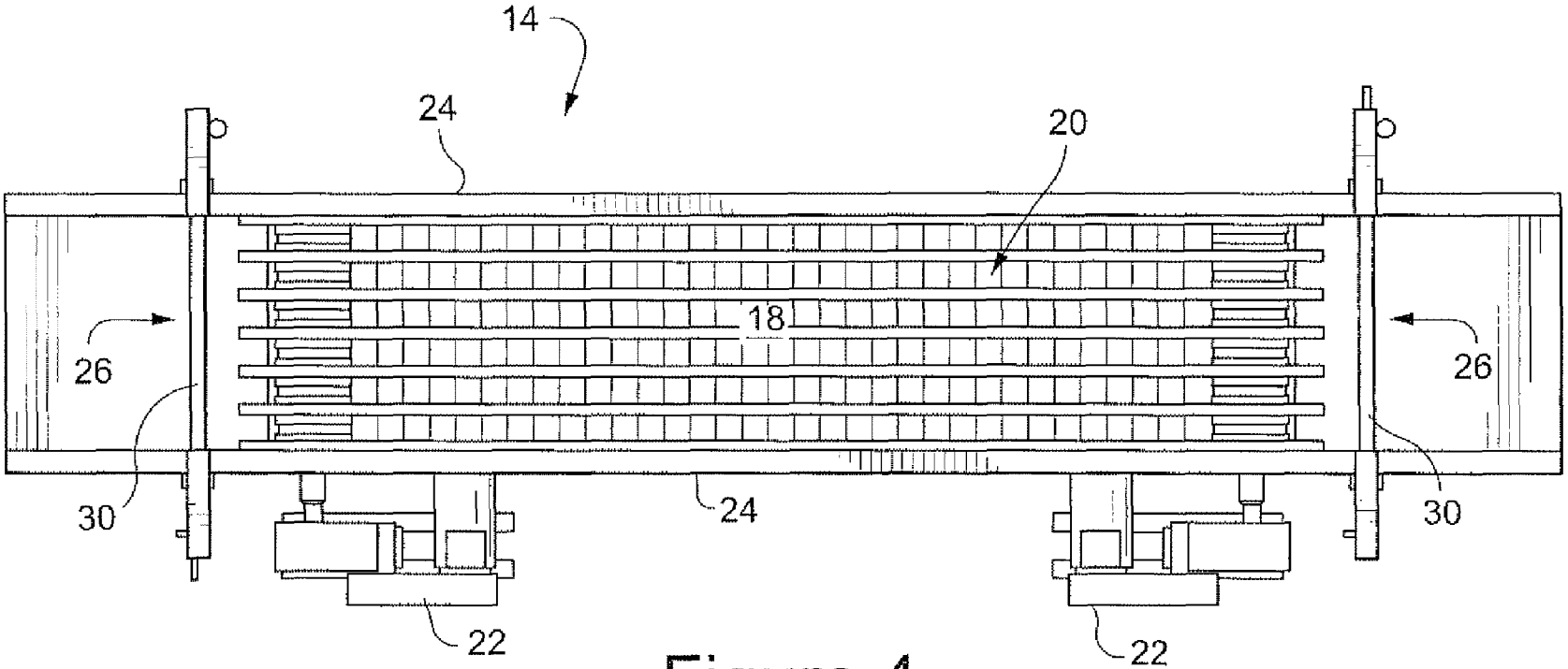
FIG. 4 is a top down view of a conveyor with a different conveying mechanism that is shown in FIG. 2.

FIG. 2 is an end view of the conveyor 14 that shows a generally orderly stack of logs 10 that have settled into the chute 18 such that the logs are arranged in parallel to each other and the chute and that the logs have filled in empty spaces in the stack to the extent practical. FIG. 3 is a perspective view of the top and side of conveyor 14. FIG. 4 is a top down view of a conveyor having an alternative conveyor mechanism, e.g., rollers or chain, that extends between but not beyond the shuffling devices 26.

The chute 18 may be a generally rectangular open trough having side walls 24 that are generally upright and a bottom floor 20 that includes the conveyor mechanism. Shuffling devices 26 lift and shift the logs in the chute in a periodic manner. The shuffling devices are arranged in the chute such that they have edges adjacent the logs. If there are two shuffling devices (as shown in FIG. 3), they may be separated by 25 feet (7 to 8 meters) for logs that are 30 to 50 feet (9 m to 15 m).

By lifting and shifting the end log sections, the shuffling devices agitate the logs. The agitation and gravity causes the logs to shift with respect to each other in the chute until the logs are aligned with the direction of movement of the conveyor and settled into a compact stack of logs in the chute. The shuffling devices 26 at opposite end sections of the conveyor may lift and shift the logs in a synchronized manner. For example, the shuffling devices may be operated out of phase with each other such that as one shuffler lifts and shifts logs in a generally upward and left direction the other shuffler lifts and shifts the logs in a generally upward and right direction. The out of phase agitation of the logs causes the logs to pitch (left to right movement) and yaw (up and down movement). The agitation of the logs may also cause them to roll. The pitch, yaw and rolling of logs causes the logs to become arranged in a compact stack and laterally aligned with the chute.

A tamping bar 28 extends across the top of the chute and pushes down log ends that project above the chute. The tamping bar keeps a height of the stack of logs in the chute to, for example, 4 feet or so. The tamping bar is an elongated plate that attaches at a pivot point at the top edge of the side wall 24 of the chute. The tamping bar may be at a mid-section of the chute. The tamping bar rotates up and down to tamp the log stack. The tamping bar is optional.

After the shuffling period, e.g., 17 seconds, the stack of aligned logs is moved by the conveyor out of the chute and into the strander. Because the logs are aligned in a compact stack when they enter the strander, the logs are well oriented for cutting. In particular, the 90-degree cuts made by the knives of the strander can be performed efficiently and with minimal wood waste due to the good alignment of the logs discharged by the chute and entering the strander. The logs are cut into wood wafers by the strander. Wafers are thin wood chips or flakes that may be formed into strandboard. The strander may also be referred to as a flaker.

The conveyor cycle of advancing logs and pausing forward movement while shuffling the logs is synchronized with the strander. For example, as the conveyor shuffles a stack of logs the strander cuts logs.

Figure 5:
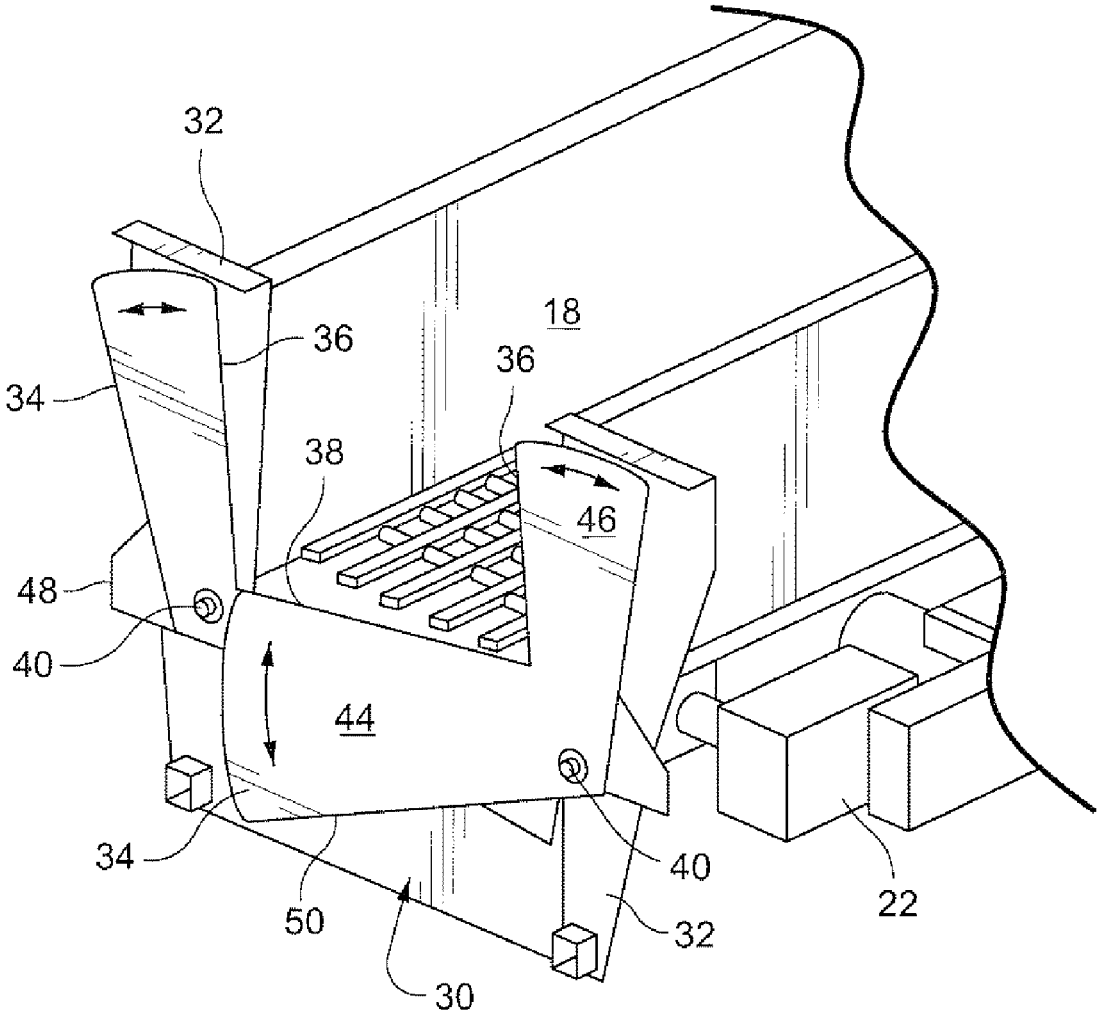
FIG. 5 is an enlarged view a shuffling device for the conveyors shown in FIGS. 2 and 4.

FIG. 5 is cut away view of the chute to show a shuffling device 26. The chute includes gaps or slots 30 to receive the shuffling device. Flanges 32 adjacent the gaps or slots provide a mount for the L-shaped plates 34 of the shuffling device. The plates are positioned side by side in the slot or gap. Each plate has a side inside edge 36 and a bottom inside edge 38 generally aligned with a side wall 24 and floor 20 of the chute. A corner section of each plate has a pivot point 40 that attaches to a post on the flange 32 of the chute. A hydraulic cylinder 42 (FIG. 3) between the corner on each plate and the flange causes the plate to pivot back and forth across the chute channel. Each plate may have a corresponding hydraulic cylinder. The pivoting motion of the plate and the abutment of the inside edges of the plate move the logs and cause the logs to shuffle and settle into stacks.

The L-shaped plates may be formed of steel or other hard and durable material capable of withstanding high impacts that arise during agitating the logs. The inside edges of the L-shaped plates are dull to not cut into the logs. The L-shape plate may include a fan-shaped bottom section 44 which includes the bottom inside edge 38 and extends the entire width of the chute 18. The fan-shape ensures that the lower edge of the L-shaped plate does not become exposed in the chute as the plate 34 reciprocates about the pivot point 40. Exposing the lower edge above the bottom 20 of the chute may allow debris to slide below the reciprocating plate and into the gap 30 in the chute. Debris in the gap may interfere with the pivoting movement of the plate 34. The L-shaped plate 34 may also include a fan-shaped upper portion 46 that includes the inside plate edge 36 and is sufficiently wide so that the outside edge of the plate is not exposed in the chute as the plate reciprocates. A lever arm 48 on the plate provides a mount for an end of the actuating cylinder 42.

The pair of L-shaped plates 34 in a single shuffling device 26 slide against each other in the slot or gap 30 of the chute. The pair of plates are sandwiched together in the slot 30. The flanges 32 of the chute shield the plates and provide guides for the plate movement.

As the bottom edge 38 of the one of the two plate rises the bottom edge of the other plate drops. Logs are lifted and lowered by the up and down movement of the two bottom plate edges 38. Similarly, as the side edge 36 of one of the two plates pushes against the stack of logs in the chute, the side edge on the opposite plate retracts from the chute.

A controller 52, e.g. computer, may actuate the cylinders for the L-shaped plates 34 and the tamping plate 28. The controller may cause each pair of pivoting plates to move in opposite directions, e.g., one plate moves clockwise while the other plate moves counterclockwise. The controller may also cause the pairs of plates forming a shuffling device 26 to move out of phase with the shuffling device on the opposite end of the conveyor. For example, the plates from both shuffling devices 26 on the same side of the chute may move in opposite directions (clockwise vs. counter-clockwise). Moving adjacent plates 34 in opposite directions, and moving the two shuffling devices 26 out-of-phase with each other facilitates the pitch, yaw and rolling motions imparted to the logs.

Pivoting the L-shaped plates lifts the bottom of the stack of logs at an angle across the width of the chute. The logs are not lifted directly upward, but are rather lifted skewed to one side of the chute and then skewed to the other side of the chute. Similarly, the side inside edges 36 of the pivoting plates push inward the top of the sides of the log stacks to a greater distance than the bottom of the sides of the log stacks. This uneven distribution of lifting and side movement of the log stacks promotes the pitch, yaw and roll of the logs.

The shuffling device need not be embodied as abutting L-shaped plates or two shuffling devices positioned in opposite ends of the chute. For example, the shuffling device may be reciprocating bumper plates arranged in the bottom and sides of the chutes or bars extending transversely across the bottom and sides of the chute, where each bar pivots about a pivot point at the corner of the chute. Further, the number of shuffling devices arranged in the chute may be two, three or more with each of the devices actuated slightly out of phase to cause the logs to yaw, pitch and roll in the chute.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A method for aligning logs in a chute comprising:

moving the logs into the chute such that logs are on top of each other;

agitating the logs to impart at least pitch and yaw movement to the logs, wherein the logs are agitated by at least two log shufflers each positioned in a respective gap in the chute and reciprocally moving in and out of the chute, such that the agitation of the logs is performed from at least two locations in the chute wherein each location corresponds to one of the shufflers, and settling the logs in the chute such that the logs are parallel to a lateral axis of the chute.

2. The method of claim 1 wherein the agitation of the logs includes the log shufflers cyclically lifting opposite ends of the logs.

3. The method of claim 1 further comprising abutting opposite sides of a stack of the logs in the chute.

4. The method of claim 1 wherein the settling of the logs yields a log stack in the chute.

5. The method of claim 1 wherein the two locations are separated by a distance less than an average length of the logs.

6. A log shuffler and conveyor assembly comprising:

a chute including a log conveyor having a bottom surface and at least one sidewall;

a gap in the log conveyor, and a log shuffler arranged in the gap of the conveyor, wherein the shuffler includes at least one pivoting plate having a first edge moving reciprocally above and below the bottom surface of the chute and the plate is in the gap.

7. The log shuffler and conveyor assembly of claim 6 further comprising a second edge of the at least one pivoting plate, wherein the second edge moves reciprocally past the at least one side wall.

8. The log shuffler of claim 6 further comprising a hydraulic actuator pivoting the plate.

9. The log shuffler of claim 6 further comprising a second pivoting plate parallel and adjacent the at least one pivoting plate, wherein the second pivoting plate is pivotably mounted to an opposite side of the chute.

10. The log shuffler of claim 6 wherein the at least one pivoting plate is an L-shaped plate.

11. The log shuffler of claim 10 wherein the L-shaped plate includes the first edge and a second edge substantially perpendicular to the first edge.

12. A log shuffler and conveyor assembly comprising:

a chute including a log conveyor having a bottom surface and at least one sidewall;

a first gap and a second gap each in the log conveyor;

a first log shuffler arranged in the first gap of the conveyor, wherein the first log shuffler includes at least one pivoting plate having a first edge moving reciprocally above and below the bottom surface of the chute, and a second log shuffler arranged in the second gap of the conveyor, wherein a distance separating the log shufflers is less than an average length of a log in the conveyor.

13. The log shuffler of claim 12 wherein the first edge of the second log shuffler pivots out of phase with the first edge of the other log shuffler.

14. A log processing system comprising:

a log conveyor including a generally straight log chute and a log conveying mechanism;

a log debarker having an output arranged to discharge logs into the conveyor;

a wood cutting device having an input to receive logs from the conveyor, and a log shuffling device positioned in a gap in the chute, wherein the log shuffling device has an edge reciprocally moving above and below a bottom of the chute, wherein the logs rest on the bottom of the chute and the edge is transverse to the logs in the chute.

15. The log processing system of claim 14 wherein said log shuffling device agitates a stack of logs in the chute.

16. The log processing system of claim 14 wherein the log shuffling device includes a reciprocating plate having the edge, wherein the edge engages at least a bottom and a side of a stack of logs in the chute.

17. The log processing system of claim 14 further comprising a strander coupled to a discharge end of the log shuffling device.

18. A log processing system comprising:

a log conveyor including a generally straight log chute and a log conveying mechanism:

a log debarker having an output arranged to discharge logs into the conveyor;

a wood cutting device having an input to receive logs from the conveyor, and a log shuffling device positioned in the log chute, wherein the log shuffling device includes a first log shuffler and a second log shuffler separated in the log chute by a distance less than a length of an average log.

19. The log processing system of claim 18 wherein the first log shuffler moves in a first agitating cyclical motion and the second log shuffler moves in a second agitating cyclical motion out of phase with the first agitating cyclical motion.

20. A log processing system comprising:

a log conveyor including a generally straight log chute and a log conveying mechanism;

a log debarker having an output arranged to discharge logs into the conveyor;

a wood cutting device having an input to receive logs from the conveyor, and a log shuffling device positioned in the log chute, wherein the log shuffler includes opposing side edges moving cyclically in and out of sidewalls of the log chute, and at least one bottom edge moving cyclically up and down through a bottom of the log chute.

* * * * *